United States Patent [19]

Boonstra et al.

[11] Patent Number: 4,499,011

[45] Date of Patent: Feb. 12, 1985

[54] RESISTANCE PASTE FOR A RESISTOR BODY

[75] Inventors: Alexander H. Boonstra; Cornelis A. H. A. Mutsaers; Franciscus N. G. R. van der Kruijs, all of Eindhoven, Netherlands

[73] Assignee: U.S. Philips Corporation, New York, N.Y.

[21] Appl. No.: 607,905

[22] Filed: May 7, 1984

[30] Foreign Application Priority Data

May 9, 1983 [NL] Netherlands ..... 8301631

[51] Int. Cl.[3] ..... H01B 1/06

[52] U.S. Cl. ..... 252/518; 428/426; 428/432; 428/539; 428/697; 338/20; 338/308; 338/309

[58] Field of Search ..... 252/518; 423/593; 428/426, 432, 539, 697; 338/20, 307, 308, 309, 314

[56] References Cited

U.S. PATENT DOCUMENTS

| | | | |
|---|---|---|---|
| 3,681,262 | 8/1972 | Bouchard | 252/520 |
| 4,107,387 | 8/1978 | Boonstra et al. | 252/518 |
| 4,124,539 | 11/1978 | Horowitz et al. | 252/518 |
| 4,129,525 | 12/1978 | Horowitz et al. | 252/518 |
| 4,175,061 | 11/1979 | Fujimura et al. | 252/518 |
| 4,176,094 | 11/1979 | Horowitz et al. | 252/518 |
| 4,269,898 | 5/1981 | Boonstra et al. | 428/432 |
| 4,277,542 | 7/1981 | Boonstra et al. | 428/697 |
| 4,301,042 | 11/1981 | Boonstra et al. | 252/518 |
| 4,303,742 | 12/1981 | Boonstra et al. | 428/697 |
| 4,397,774 | 8/1983 | Boonstra et al. | 252/518 |
| 4,415,486 | 11/1983 | Boonstra et al. | 428/432 |

*Primary Examiner*—Joseph L. Barr

*Attorney, Agent, or Firm*—Norman N. Spain

[57] ABSTRACT

A resistance paste for the manufacture of a resistor body, for example, by silk-screening and the resistance body manufactured herewith, which paste comprises a mixture of $Pb_2Rh_xRu_{2-x}O_{7-y}$, a permanent binder and a temporary firable binder. In the formula $0.15 \leqq x \leqq 0.95$ and $0 \leqq y \leqq \frac{1}{2}$. The resulting resistor body in the temperature range from $-55°$ to $+150°$ C. has a temperature coefficient of the resistance between $-10 \times 10^{-6}$/°C. and $+10 \times 10^{-6}$/°C. and is very stable. The resistance variation during the life of the resistor is smaller than $\pm 0.5\%$.

5 Claims, No Drawings

RESISTANCE PASTE FOR A RESISTOR BODY

The invention relates to a resistance paste for a resistor body comprising a mixture of a metal oxidic compound, a permanent binder and a temporary binder, and to a resistor consisting of the resistance material which is provided on a substrate and from which the temporary binder has been removed by heating and which comprises lead wires.

U.S. Pat. No. 3,681,262 discloses metal oxidic compounds which are used in such a paste to manufacture resistor bodies. They must satisfy the general formula $$(M_xBi_{2-x})(M'_yM''_{2-y})O_{7-z}$$

wherein

M is at least one metal selected from the group Y, Tl, In, Cd, Pb and a rare earth metal of atomic number 57–71, inclusive, m' is at least one metal selected from the group Pd, Ti, Sn, Cr, Rh, Re, Zr, Sb and Ge, M'' is at least one of the metals Ru and Ir, X is a number in the range 0–2, y is a number in the range 0–2, and z is a number in the range 0–1, which is at most equal to x/2, when M is a bivalent metal.

A disadvantage of most of these compositions is, that the temperature coefficient of the resistor in the temperature range from −55° to +150° C., which is interesting for practical applications, is rather large and varies rather considerably within said range. Another disadvantage which very often occurs is that the resistance value varies considerably in the course of time.

It is the object of the invention to provide a resistance paste for manufacturing a resistor body which has a resistance value which does not vary by more than ±0.5% during the whole life of the resistor body. Moreover the temperature coefficient of the resistor within the temperature range from −55° to +150° C. must remain between $-10\times10^{-6}$/°C. and $+10\times10^{-6}$/°C. Life is to be understood to mean herein 25 years at a temperature of 50° C. As a measure of this an accelerated life test for 100 hours at 200° C. is conducted.

The resistance paste according to the invention is characterized in that the metal oxidic compound satisfies the formula $$Pb_2Rh_xRu_{2-x}O_{7-y}$$

wherein $0.15\leqq x\leqq 0.95$ and $0\leqq y\leqq \frac{1}{2}$.

Obtaining such a high stability of the resistor body obtained after firing a resistance paste according to the invention during the operating life of the resistor is to be ascribed to the fact that the components of the resistance-determining metal oxidic compound show a negligible migration in the usual glasses used as a permanent binder.

A type of glass to be considered as having a preferred composition range in this respect is characterized by the components PbO, $SiO_2$, $AlO_{1\frac{1}{2}}$ and $BO_{1\frac{1}{2}}$ between the following limits in mol.%.

| | |
|---|---|
| $SiO_2$ | 10–45 |
| PbO | 25–35 |
| $BO_{1\frac{1}{2}}$ | 20–60 |
| $AlO_{1\frac{1}{2}}$ | 0–15. |

The resistivity of the fired resistance paste can be adjusted by varying the ratio of the resistance-determining metal oxidic compound to the permanent binder, so that the resistance-determining component is more or less "diluted". The temperature coefficient of resistance is very accurately adjusted to the desired value by a correct choice of x. As a result of the negligible migration of the components of the metal oxidic compound in the resistor body, a very constant temperature coefficient of the resistance is measured in the life-test.

Another method of adjusting the value of the resistivity is by adding an insulating oxide, for example, aluminum oxide or titanium dioxide to the resistance paste, which oxide is poorly soluble in or reacts with the remaining components with difficulty.

A few examples will now be described for illustration of the invention. The compounds $Pb_2Rh_xRu_{2-x}O_{7-y}$ used in the examples are prepared as follows. The starting material is an alkaline solution of potassium ruthenate. The quantity of $Rh(NO_3)_3$ solution determined by the desired value of x is added to this alkaline solution. The final pH of the solution must exceed 12. A threefold quantity (mol.) of $Pb(NO_3)_2$ solution with respect to the sum of ruthenate and rhodate is added to the resultant mixture. In this case also, a final pH exceeding 8 should be ensured by adding KOH, if necessary. The resulting precipitate is filtered off, washed twice with water and, after drying, fired in air at 700° C. for 1 hour. The excess of PbO is then removed with dilute $HNO_3$ and the residue is dried in air at 150° C.

EXAMPLE 1

Glass powder having an average particle size of approximately 1 μm and a composition

| | | |
|---|---|---|
| PbO | 26.1 mol. % | 61% by weight |
| $SiO_2$ | 38.2 mol. % | 24% by weight |
| $BO_{1.5}$ | 24.5 mol. % | 9% by weight |
| $AlO_{1.5}$ | 11.2 mol. % | 6% by weight |

is mixed in a weight ratio 1:1 with a resistance material $Pb_2Rh_{0.80}Ru_{1.20}O_{6.5}$ having a particle size smaller than 0.2 μm. It is then processed to a paste with one or more binders and solvents, for example, ethyl cellulose in benzyl benzoate. The paste is provided by means of silk-screening on an aluminum oxide substrate which was previously provided with AgPd contacts. The printed substrates were dried and then heated in air according to a firing program having 850° C. as the peak temperature.

With a layer thickness of 15 μm, the resistors have a value of 2.5 kOhm per square, a TCR of $-8\times10^{-6}$/°C. in the range from −55° to +20° C. and a TCR of $+7\times10^{-6}$/°C. in the range from +20° to +150° C.

EXAMPLE 2

A silk-screening paste is made by mixing the glass powder of Example 1 in a weight ratio 6:1 with a resistance material $Pb_2Rh_{0.25}Ru_{1.75}O_{6.5}$ which has a particle size below 0.2 μm. The silk-screened resistance patterns which are provided on a substrate as in Example 1 are subjected, after drying, to a firing program having a peak temperature of 750° C. The resulting resistors have a value of 0.3 MOhm per square with a layer thickness of 15 μm, a TCR in the range from −55° to +20° C. of $-6\times10^{-6}$/°C. and in the range from +20° to +150° C. of $+9\times10^{-6}$/°C.

EXAMPLE 3

Glass powder having an average particle size of approximately 1 μm and a composition of

| | | |
|---|---|---|
| PbO | 29.5 mol. % | 65% by weight |
| $SiO_2$ | 43.0 mol. % | 25.5% by weight |
| $BO_{1.5}$ | 27.5 mol. % | 9.5% by weight |

is mixed in a weight ratio of 1:4 with a resistance material $Pb_2Rh_{0.5}Ru_{1.5}O_{6.5}$ and processed to a paste. Resistors are silk-screened therefrom on an $Al_2O_3$ substrate and the assembly is subjected to a firing program having a peak temperature of 850° C. The resulting resistors with a layer thickness of 15 μm have a value of approximately 50 kOhm per square. The TCR is $-9\times10^{-6}$/°C.(−55°→+20° C.) and $+6\times10^{-6}$/°C.(+20°→+150° C.).

EXAMPLE 4

2% by weight of $TiO_2$ are added to the paste described in Example 3. The substrate with the resistors silk-screened thereon is subjected to a firing program having a peak temperature of 750° C. The resistors have a resistance value of 0.8 MOhm/square with a layer thickness of 15 μm. The TCR is $-9\times10^{-6}$/°C.(−55°→+20° C.) and $+6\times10^{-6}$/°C.(+20°→+150° C.)

For testing their stability, the resistors are subjected to an accelerated life test at 200° C. in air for 200 hours.

The resistance values of all the above-described resistors after termination proved to have a variation of less than 0.5%.

What is claimed is:

1. A resistance paste for a resistor body consisting of a mixture of a metal oxidic compound, a permanent binder and a temporary binder, characterized in that the metal oxidic compound satisfies the formula:

$$Pb_2Rh_xRu_{2-x}O_{7-y}$$

wherein $0.15\leqq x\leqq 0.95$ and $0\leqq y\leqq \frac{1}{2}$.

2. A resistance paste as claimed in claim 1, characterized in that the permanent binder is a glass having a composition in mol.%:

| | |
|---|---|
| $SiO_2$ | 10–45 |
| PbO | 25–35 |
| $BO_{1.5}$ | 20–60 |
| $AlO_{1.5}$ | 0–15. |

3. A resistance paste as claimed in claim 1, characterized in that it also comprises an insulating oxide which is poorly soluble in and poorly reacts with the remaining components of said paste.

4. A resistor body comprising a substrate having lead wires covered with a resistance material, characterized in that the resistance material is a resistance paste as claimed in claim 1, from which the temporary binder has been removed by heating said paste.

5. A resistance paste as claimed in claim 2, characterized in that it also comprises an insulating oxide which is poorly soluble in and poorly reacts with the remaining components of said paste.

* * * * *